US006041714A

United States Patent [19]

Trent et al.

[11] Patent Number: 6,041,714

[45] Date of Patent: Mar. 28, 2000

[54] STATICALLY DISSIPATIVE, NON-METALLIC CENTER BOWL LINER FOR RAILROAD CARS

[75] Inventors: Robert S. Trent, Steger, Ill.; Robert M. Manley, Richmond, Tex.

[73] Assignee: Holland Company, Crete, Ill.

[21] Appl. No.: 08/949,754

[22] Filed: Oct. 14, 1997

Related U.S. Application Data

[60] Provisional application No. 60/042,080, Mar. 28, 1997.

[51] Int. Cl.[7] ..... B61F 5/16

[52] U.S. Cl. ..... 105/199.4; 384/422

[58] Field of Search ..... 105/199.4; 384/422, 384/907.1

[56] References Cited

U.S. PATENT DOCUMENTS

| | | | |
|---|---|---|---|
| 4,075,951 | 2/1978 | Chierici et al. | 105/199.4 |
| 4,188,888 | 2/1980 | Cooper et al. | 105/199.4 |
| 4,222,331 | 9/1980 | Gage et al. | 104/199.4 |
| 4,241,667 | 12/1980 | Wulff | 105/199.4 |
| 4,308,801 | 1/1982 | Cooper et al. | 105/199.4 |
| 4,746,574 | 5/1988 | Hattori et al. | 428/409 |
| 5,288,168 | 2/1994 | Spencer | 405/54 |
| 5,443,015 | 8/1995 | Rudibaugh et al. | 105/199.4 |
| 5,514,299 | 5/1996 | Kalwara | 252/511 |

*Primary Examiner*—S. Joseph Morano

*Attorney, Agent, or Firm*—Lee, Mann, Smith, McWilliams, Sweeney & Ohlson

[57] ABSTRACT

A conductive center bearing liner for railroad car center plate assemblies comprising a bowl shaped or flat round horizontal member formed from a cross-linked ultra high molecular weight polymer specially mixed with a conductive material shaped to define a floor portion and alternative embodiments with an upstanding side wall. Another embodiment concentrates the conductive material in a selected sector of the disk portion of the liner. The conductive liner eliminates the need to incorporate special apparatus to ground the car body center plate to the truck bolster bowl. This grounding method eliminates the wear and erosion that occurs by grounding using conventional methods.

13 Claims, 2 Drawing Sheets

STATICALLY DISSIPATIVE, NON-METALLIC CENTER BOWL LINER FOR RAILROAD CARS

CLAIM OF PRIORITY

Priority is claimed based on Provisional Application Serial No. 60/042,080 filed Mar. 28, 1997.

DESCRIPTION OF RELATED ART

Prior art rail car truck bowl liners come in several categories. Early liners were made of hard metal alloys such as manganese steel, however these need to be lubricated periodically, which is burdensome and expensive. Certain recent liners are composed of an ultra high molecular weight polymer, which eliminated the need for lubrication. However, such liners needed to have separate grounding apparatus added since the liner is nonconductive.

A third category is a hybridized composite liner that utilizes metal reinforcement in a polymer matrix. The metal provides some conductivity, but not necessarily at a desired level. Finally, a molded polyurethane bowl liner using entrained carbon fiber is known, but the proportions are specifically different and a for the purpose of ablation of the carbon fiber as the polyurethane wears, to provide lubrication. These properties are different from, and are specifically avoided in, the present invention which relies primarily on the self-lubricating properties of the polyethylene.

SUMMARY OF THE INVENTION

This invention relates to a grounding product for railroad car center plate assembly bowl liners of the all polymeric type, and more particularly providing for effective grounding without the use of conductive plates, clips or shunts attached to the liner, as disclosed in Wulff U.S. Pat. No. 4,241,667, granted on Dec. 30, 1980. The liner material used herein has similar mechanical properties to the liner as disclosed in Chierici and Murphy U.S. Pat. No. 4,075,951, granted on Feb. 28, 1978, but has improved electrical properties. The disclosures in Wulff U.S. Pat. No. 4,241,667 and Chierici and Murphy U.S. Pat. No. 4,075,951, are incorporated by reference.

Railroad cars are commonly in the form of a body resting on and swivelly connected to a pair of trucks adjacent each end of the car. The swivel connection involved in each truck is generally formed by the car body bolster center plate resting on the truck bolster bowl, with these parts being pivotally connected by a center pin assembly. The reason for the swivel connection is to accommodate motion such as occurs during the car rounding turns and shakes imposed on the railroad car such as caused by track discontinuities while doing minimal damage to the car itself and cargo. Such cars commonly had a manganese steel liner captured between the center plate and the truck bolster bowl. A disadvantage of the manganese steel liner between the two components that has been recognized is that frequent lubrication is necessary. If a car with this old style all metal liner went unlubricated, the swiveling motion would be inhibited and could possibly cause a derailment. At a minimum, excess wear would be caused to the car center plate, the truck center bowl, or both.

The Chierici and Murphy patent referred to above discloses a special truck bolster bowl liner that was devised to replace the conventional and troublesome manganese steel liner. The Chierici and Murphy liner is in the form of a bowl shaped member or body formed from an ultra high molecular weight polymer of dry self lubricating characteristics. An ultra high molecular weight polyethylene (UHMW-PE) is preferred, and the bowl member is shaped to define a floor portion and an upstanding side wall portion which is in circumambient relation about the bowl liner floor portion.

The bowl liner side wall is proportioned to space the car body bolster center plate from the truck bolster bowl side wall, about the circumference of these components, and hold the body bolster center plate in such spaced relation against end of car impacts, whereby such impact forces transmitted between the car body bolster center plate and the truck bolster bowl side wall are spread over 180 degrees of the bolster components involved thereby avoiding overstressing of these components. In the flat horizontal liner, these side loads are borne by a separate liner, usually of steel, held in place in the truck bolster bowl. The problem with the previously disclosed liners are that they are nonconductive, necessitating the addition of some grounding apparatus such as that disclosed in the Wulff patent.

Several alternative embodiments are also present to this bowl liner configuration, which can be adapted to the static dissipative characteristics of the instant invention. One option is to use a UHMW-PE flat horizontal disk formed liner to bear the car bolster center plate. In this embodiment, sidewards loads on the bolster assembly are borne by a metal liner or wear ring welded to the truck bolster, filling the space between the center plate and truck bolster bowl. This embodiment is referred to as a flat horizontal liner. In addition, additional configurations for a top edge seal on an all plastic bolster bowl liner are also possible.

The Chierici and Murphy all plastic bowl liner of said patent establishes two slip surfaces in the center plate assembly, one on either side of the bowl liner, that insures adequate truck swiveling action even under severe operating contingencies, and further provides for a wear resisting resurfacing of the bolster surfaces engaged by the bowl liner whereby the center plate assemblies involved become effectively resistant against further wear, as disclosed in said patent.

The American Association of Railroads requires that railroad car center plate assemblies be arranged so that the body bolster center plate will be sufficiently grounded to the truck bolster bowl. Standards for static electricity conductivity, in other industries such as ANSI/NFPA77 make it desirable to form and arrange the center plate assembly so that it will offer no more than about $1\times10^6$ ohms (100 Kohms) resistance to electrical current flow therethrough. The invention here exceeds the NFPA standards by an order of magnitude, there being no quantitative AAR standard. The purpose is to assure that any electric charge that might tend to build up in the car body or be induced in same will be discharged through the car trucks to the track rails.

Where the car body center plate acts directly on the bolster bowl, or where the commonly employed manganese steel liner is employed between the two, the metal to metal contact involved has been considered adequate to meet static dissipation standards. While the grounding standard is met, there remains the wear and damage problem in the center plate assembly area of the car.

Railroad cars having their center plate assemblies equipped in accordance with said Chierici and Murphy patent have the benefits described in said patent. However, as the polymeric material from which the liner is formed is electrically insulating or dielectric in nature, the car body bolster center plate and the truck bolster bowl have been considered to require grounding therebetween, at least for certain types of cars, even though the bolster center pin may provide a measure of electrical conductivity to the trucks.

Cars using a liner as disclosed in Chierici et al also had to incorporate grounding apparatus, as disclosed in the Wulff patent. Grounding methods such as the one disclosed in Wulff all use some form of conductive shunt clip and metal rivets to provide an artificial path between the car body center plate to the truck bolster bowl. These methods are disadvantageous in that they are subject to wear and tear, and after extended use the conductors can be recessed below the surface area of the liner to a point where they have a less effective contact area.

As the grounding clip or shunt exists for the purpose of providing unlubricated metal to metal contact, it also provides increased friction over that provided by the Chierici et al all UHMW-PE liner. The previous grounding method is also disadvantageous in that periodic inspection of the grounding clips may be necessary, requiring costly disassembly of the center plate assembly. Wear of the grounding clip, present for the purpose of providing metal to metal contact, can result in the frictional wearing of the clip sufficient that it becomes dismembered and therefore the electrical contact is, in any event, broken. There are also potential difficulties in the fact that the shunt or clip provides for contact in a relatively small portion of the total bearing surface. As a car rolls or pitches there is the risk of intermittent contact if the orientation of the shunt is not roughly perpendicular to the axis of the aforesaid pitching or rolling movement.

The present invention is concerned with providing a liner with all the benefits as disclosed in the Chierici et al patent and in addition being conductive, thereby eliminating the need for any additional grounding apparatus.

The liner is composed of a base ultra high molecular weight polyethylene (UHMW-PE) material with a conductive material additive. The preferred composition is UHMW-PE specially mixed with 2.0% carbon black. The conductive material, such as carbon black sold on the market as Monarch 700 anti-static agent, can be added as a particulate to UHMW-PE in particulate or powder form and then the mixture heated under mold pressure for thermoforming. With other plastics, or other molding or forming methods, the conductive material may be added as described above with UHMW-PE or possibly mixed with a plastic in its solid pelletized form or the conductive carbon black material may be added while the plastic is liquified for thermoforming. It is also possible that an appropriate thermosetting plastic could be used as the self-lubricating matrix with conductive material mixed therein and the liquified thermosetting plastic cured to form a liner having the requisite mechanical and electrical properties.

It will be noted that other plastics can be formed as ultra high molecular weight material. At the present time, polyethylene is preferred both for performance and economic reasons. However, other polymers would prove to be suitable and applicants do not wish to be limited only to the invention as claimed.

This improved liner still has all of the same properties that make the liner as disclosed in Chierici et al so beneficial, with the additional benefit that the liner is now conductive. Any electrical charge built up in the car body will be discharged through the liner into the car trucks and discharged into the track rails.

BRIEF DESCRIPTION OF THE DRAWINGS

The following drawings, in which like reference characters indicate like parts, are illustrative of embodiments of the invention and are not intended to limit the scope of the invention in any manner whatsoever, as encompassed by the claims forming a part hereof.

DETAILED DESCRIPTION OF THE PREFERRED EMBODIMENT

Figure 1:
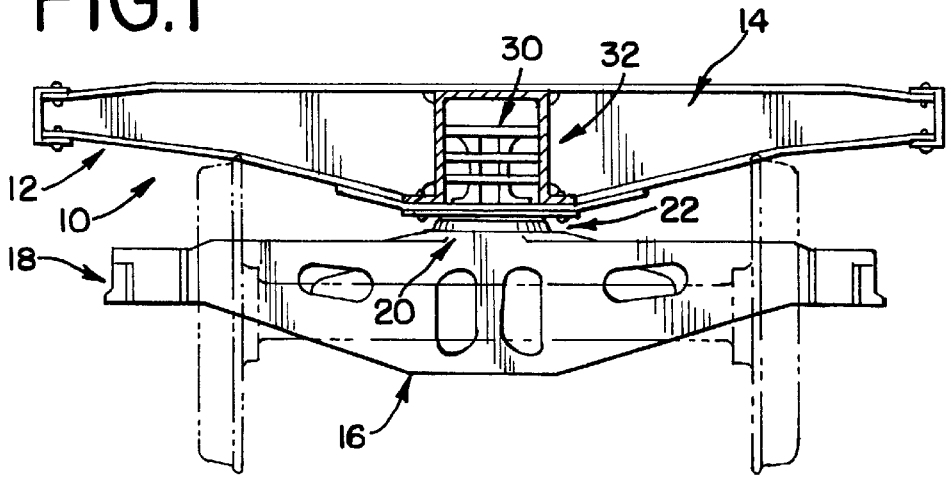
FIG. 1 is a diagrammatic transverse cross-sectional view through a railroad car body underframe at one of its body bolsters, showing some parts of same and the supporting truck bolster in elevation, with the truck wheels being shown in phantom and the truck side frames omitted for ease of illustration.

Reference numeral 10 generally indicates a railroad car in diagrammatically illustrated form and shown to comprise car body underframe 12 having a car body bolster 14 resting on and swivelly connected to truck bolster 16 of railroad car truck 18. The truck 18 and its bolster 16 are of any conventional type and thus are only diagrammatically illustrated.

The connection of the car body bolster 14 to the truck bolster 16 is effected utilizing center plate assembly 20, which in accordance with the present invention comprises truck bolster bowl 22 (see FIG. 2) that is integral with the bolster 16 and defines upstanding side wall 24 and floor wall 26, in which is received body bolster center plate 28 that in the form shown is integral with center filler 30 suitably fixed to the underframe center sill 32 for forming the "center plate" of body bolster 14. As is conventional, the truck bolster bowl floor 26 and center plate 28 are apertured as indicated at 34 and 36, respectively, to receive the conventional kingpin 37 (only a fragment is shown) that swivelably connects these components together. Bowl 22 and center plate 28 are of standard shaping, and thus bowl wall 24 is shown to include the usual recessed edge 35 that normally functions to retain the conventional manganese steel liner in the bowl 22.

The body bolster center plate 28 comprises an upstanding side wall 40 that is integral with planar wall portion 42 that seats within the bolster bowl 22. As is well known in the art, the center plate 28 may be a separate component, or part of a separate component suitably fixed to the center sill 32 and/or the body bolster 14, or plate 28 may be an integral part of bolster 14 or parts of same.

In accordance with the present invention, a liner 44 of special characteristics is interposed between the body bolster center plate 28 and the side wall 24 and floor 26 of the bolster bowl. Liner 44 is formed of dry self lubricating material to eliminate the need for applying separate lubricating materials to the center plate assembly 20, which in turn permits the center plate and bowl area of the car to be free of wet type lubricants that are customarily used for this lubrication, but also accumulate wear inducing foreign matter.

Figure 2:
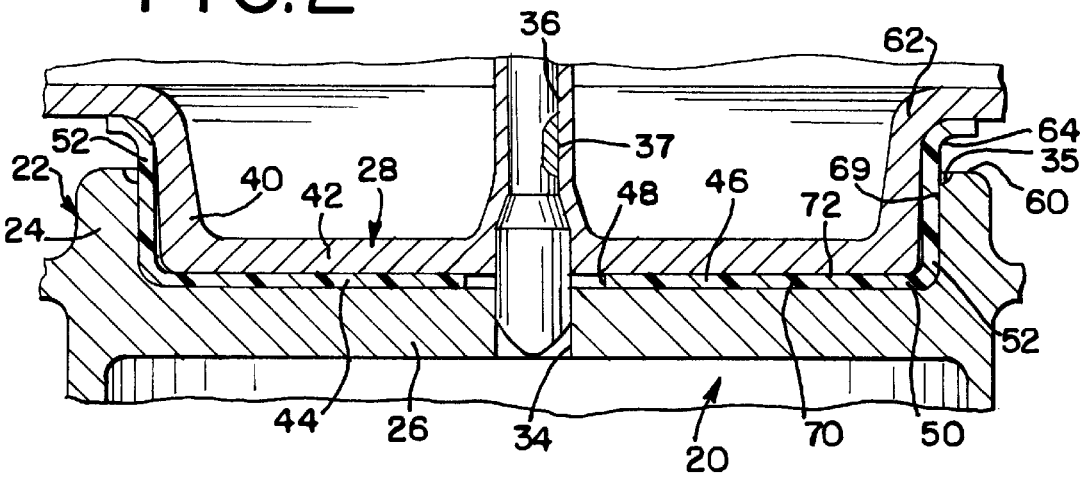
FIG. 2 is a fragmental vertical cross-sectional view through the center plate assembly shown in FIG. 1 illustrating one arrangement of the center plate components and self lubricating liner in accordance with this invention.
Figure 3:
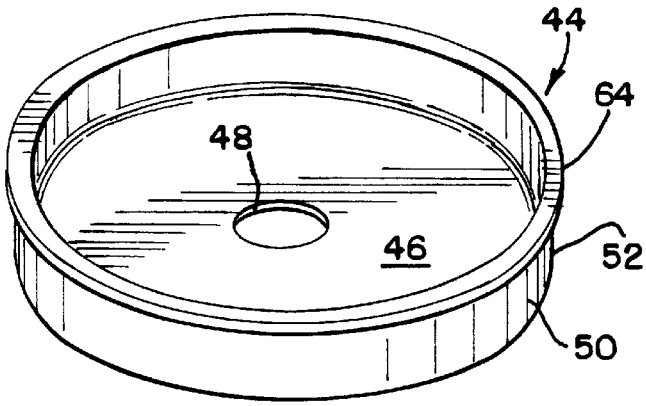
FIG. 3 is a perspective view of the liner.
Figure 4:
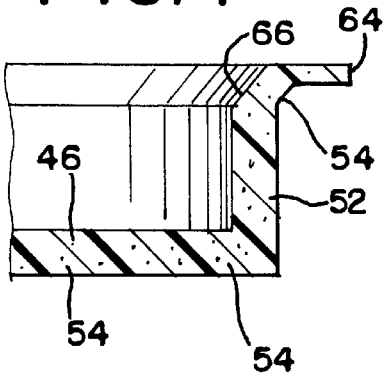
FIG. 4 is a fragmental vertical sectional view of the liner of FIG. 3 showing same as separated from the center plate assembly.

In the form of FIGS. 2–4, the liner 44 is of dished, bowl like configuration, and comprises a floor or disc portion 46 of rounded configuration that is apertured at 48 to receive the aforementioned conventional kingpin. The liner 44 about the outer margin 50 of its floor disc portion 46 includes upstanding side wall 52 that is in circumambient relation thereabout and that is continuous and uninterrupted about its circumference, as indicated in FIG. 3.

The liner 44, in accordance with the invention, is defined by a high density polymer of dry self lubricating characteristics that is pliable but non-stretchable and is thus free from distending or stretching characteristics and that is sufficiently compaction resistant to resist any substantial compaction under compressive forces up to its elastic limit, and has a high degree of elastic memory for full return to original shape after being stressed, up to its elastic limit. The liner is also conductive, made from ultra high molecular weight polyethylene specially mixed with a conductive material such as 2% carbon black. This carbon black is known on the market as Monarch 700 anti-static agent.

While the use of carbon black mixed with plastics is known, this combination of materials has not heretofore been found useful in the unique application of a self-lubricating rail car center bowl liner. A combination of mechanical, chemical and electrical traits need to be optimized for a center bowl liner to be designed to meet all these competing needs. A standard carbon black mixture with carbon black mixed with ultra high molecular weight polyethylene is 1% carbon black. The particulate carbon black 54 is shown in FIG., 4. The distribution is shown here diagrammatically and the distribution is not to be considered to be shown quantitatively in this Figure. As is discussed, the carbon black particles 54 are in a proportion of about 2% to the UHMW-PE matrix material into which particles 54 are mixed for substantially uniform distribution. It is also possible that other particulates may be suitably mixable in the proportions and having the properties claimed herein.

It will be noted that rail car center bowls are designed to withstand loads imposed by cars having a mass bearing on each center bowl on the order of 25,000 to 122,000 pounds depending on the specific cars' contents and construction standards. These loads are imposed by both static and dynamic forces although the dynamic forces can sometimes exceed the 122,000 lbs described above. It is critical to maximize the properties of the liner material in both the chemical and mechanical areas to preserve the self lubricating feature as well as wear resistance and resistance to compression, deterioration and disintegration. Accordingly, standard carbon black UHMW-PE mixtures may have been made for other applications, such as coloration of plastic, at the 1% carbon black percentage.

It is also expected that the load placed on the liner by the weight carried in the car has beneficial effects on the properties of the liner with the disclosed proportion of entrained carbon black conductive material in that the liner is compressed under load. As the distance between the particles decreases, as at high tare weights, then conductivity increases as a static charge has a smaller distance to travel. Thus, there would be an increase in conductivity in a car, such as a railroad tank car, which is fully loaded, when compared to an unloaded car, which in this instance will correspond to the time for the most desirable increase in conductivity, as the car is being loaded.

Another advantage provided by the instant invention, using the carbon black in the proportion described herein is that as described in the Chierici et al patent, there is a polishing and wear hardening that occurs using the all UHMW-PE liner. Because the carbon black conductive material is uniformly contained with in the UHMW-PE matrix, as that matrix undergoes ablation by this wear process, new carbon black particulates are exposed as the matrix wears. Thus, while as explained below, the walls of the liner are arranged to minimize contamination of the self-lubricating surfaces of the liner from the exterior, to the extent contamination occurs, there would be more carbon black material exposed as the UHMW-PE matrix wears or ablates.

Including too much carbon black mixed with the plastic interferes with the self-lubricating properties of the UHMW-PE. In the Rudibaugh U.S. Pat. No. 5,443,015 prior art patent, 5% carbon black was mixed with castable thermoset urethane for the purpose (the opposite of that desired here) of ablating a sufficient amount of carbon so that the lubricating properties of the carbon will be effective in lubricating the urethane wear plate. Because the instant invention relies on the advantages of the self-lubricating UHMW-PE material, the 5% limit for the urethane wear plates provides substantiation for the upper limit of applicants' range of carbon black. It is not, however, an absolute upper limit because of the different properties of the urethane and self-lubricating UHMW-PE.

The full bowl liner embodiments of the invention contemplate that the liner side wall 52 and floor portion 46 are proportioned to fully fill the space between the truck bolster bowl and the body bolster center plate that would not permit any lost motion movement of the center plate 28 relative to bowl 22 in the plane of these components. Thus, the side wall 52 of liner 44 is proportioned to fill the space between the bowl side wall 24 and the body bolster center plate side wall 40 to the extent that bowl wall 24 holds the liner 44 against movement in the plane of bowl 22, and liner 44 holds center plate 28 against movement in the same plane. Of course, the liner 44 is not closed across the aperture 48 so as to permit application of a conventional kingpin, and, as indicated in FIG. 2, liner 44 need not have the inner surfacing along floor 46 or wall 52 fully complement the normal tapered external surfacing of center plate 28 at the lower portion of its wall 40. It is only necessary that the liner wall 52 have a thickness such that at the upper level of bowl wall 24, just below recess 35, the liner wall 52 fully fills the space between center plate wall 40 and bowl wall 24, so as to preclude movement of the center plate 28, relative to bowl 22, in the plane of center plate assembly 20.

Figure 5:
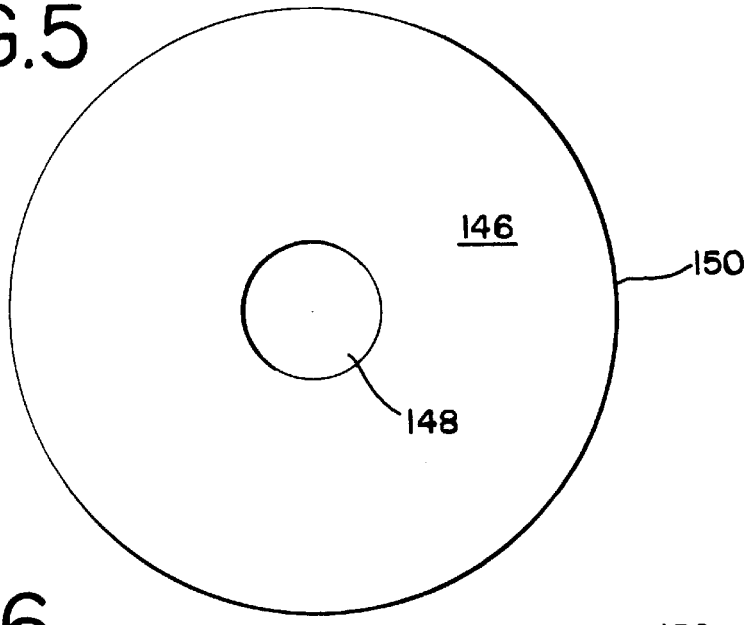
FIG. 5 is a top plan view of the flat horizontal embodiment of the static dissipative liner.
Figure 6:
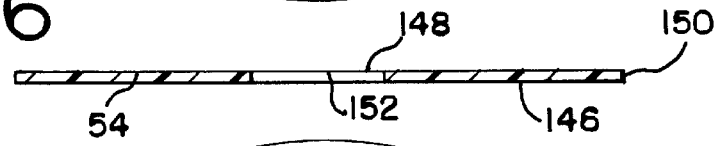
FIG. 6 is a fragmental vertical sectional view of the flat horizontal embodiment of the static dissipative liner of FIG. 5.

In FIGS. 5 and 6, the preferred flat horizontal disk 146 is provided with aperture 148 through which kingpin 36 (FIG. 1) and related assemblies may pass. Outer or peripheral edge 150 is sized such that disk 146 will fit inside a metal collar style wear liner fitted to a truck bolster, in the manner described in the background of the invention and as is known in the field. In the sectional view FIG. 6, the flat configuration of disk 146 is shown as is wall 152 which defines aperture 148.

Figure 7:
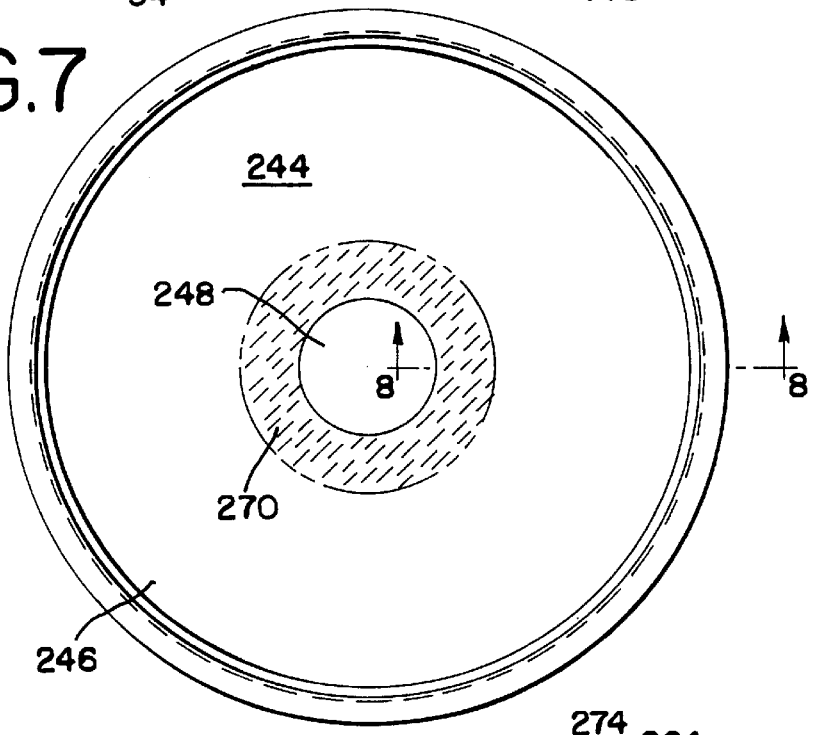
FIG. 7 is a top plan view of an alternative embodiment of the bowl liner in accordance with this invention.
Figure 8:
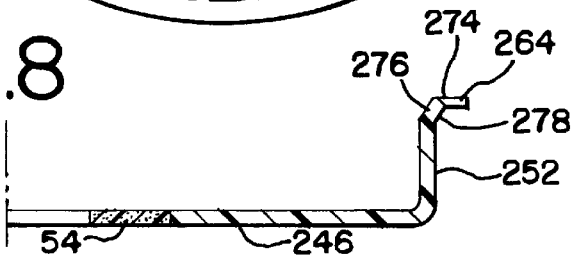
FIG. 8 is a fragmental vertical sectional view of the liner of FIG. 7.

FIGS. 7 and 8 show another approach, using a full bowl liner 244 having a floor or disk portion 246 with kingpin aperture 248 and upstanding wall 252 terminating in flange 264. There are mechanical and electrical conductivity improvements in this embodiment. Disk portion 246 has two major subdivisions, a conductive ring 270 which has the disclosed 2% to about 5% conductive material molded or entrained in the plastic and an outer ring 272 composed of the structural self-lubricating plastic, preferably UHMW-PE. This can be molded using known plastic molding techniques such as compression molding. Preferably known plastic molding techniques can be used to partially mold the outer ring 272, wall 252 and flange 264 as a unit and then placing the solid particulate plastic and conductive material mix in position to form ring 270 and then reheating the entire unit under pressure to form a substantially unitary disk portion 244 simply with a concentration of conductive material in a preselected location.

Flange 264 includes a horizontal portion 274 with an internally conical bevel 276 which will fit closely against the car bolster as shown in FIG. 1. Exterior radiused ring portion 278 provides for better support of flange 264 and potentially improved sealing against the truck bolster.

The mechanical features of the UHMW-PE bowl liner include the configuration to fit in the space between the truck bolster bowl 22 and the body bolster center plate 28 to limit lost motion movement of the center plate 28 relative to wall 52 of bowl 22 in the plane of these components and also to provide vertical support for center plate 28 in bowl 22. Liner 44's preferred UHMW-PE material resists distension or stretching, and any substantial compaction due to compression (up to its elastic limit). Liner 44 holds these components firmly spaced apart and against forces, and especially impact forces. The UHMW-PE material disperses loads, is itself highly resilient to such loads, particularly when captured between main load bearing components like center plate 28 within bowl 22 and has the beneficial self-lubricating properties as described in greater detail in the cited patents which are incorporated by reference.

The configuration of liner 44 is much like the older steel liner. As disclosed in the earlier patents, liner wall 52 does not seat in any way on the top surfacing 60 of the bowl 22 or its recess 35, rising straight out of the bowl interior for firm engagement with the neck portion 62 of center plate wall 40, 360 degrees thereabout. This effects a seal about the center plate neck portion 62 that precludes entry of foreign material between the liner 44 and center plate 28.

Flange 64 extends outwardly from bevelled portion 66, itself at the top of wall 52 at an approximately 90 degree angle. This provides a level of line sealing contact with the center plate neck portion 62. The precise dimensions and proportions can be adapted to particular center bowl needs. This configuration, building on the teachings of Chierici and Murphy is not required in order to practice the invention according to the teachings herein.

Liner 44 freely carried in its captured location between bowl 28 and center plate 28. This embodiment forms two slip surfaces with the center plate assembly 20 to insure the needed swivelling action of the car trucks 18 with respect to the car body 12.

It is expected that the configuration shown in FIG. 7 and FIG. 8 may be preferred over this older configuration.

The flat disk of FIGS. 5 and 6 could also be made pursuant to either the uniform distribution of conductive material embodiment or with a more concentrated inner conductive ring, as described above. Of course the flat disk version of FIGS. 5 and 6 provides the flat slip surfaces in a car that has a partial metal liner.

The primary slip surface is between the upper surface 72 of the liner 44 and the body bolster center plate 28's lower surface or planar wall 42. Liner 44 also forms a secondary contingency slip surface 70, the lower surface of the liner 44 and the truck bolster floor 26.

The liner 44, 146, in accordance with this invention, can both meet the from 0.15 to 0.20 coefficient of friction of the all UHMW-PE liner (Chierici et al and Murphy) relative to the surfaces of the body bolster center plate 28 and bolster bowl 22 and also meet the electrical conductivity standards of $1\times10^5$ ohms (100 Kohms), although coefficient of friction under load can temporarily be higher. As such, it is an improvement over both the all UHMW-PE liner, which has a high resistance, and the clip or shunt grounded version (Wulff) which has an inconsistent coefficient of friction due to the interference of the shunt or clip with the uniform contact of surfaces 70, 72.

As many and varied modifications of the subject matter of this invention will become apparent to those skilled in the art from the detailed description given hereinabove, it will be understood that the present invention is limited only as provided in the claims appended hereto.

In accordance with our invention, we claim:

1. A center bowl liner for a rail appliance comprising, in part a homogenous mixture of a conductive material in a self-lubricating plastic material having self lubricating properties;

said conductive material is carbon black powder;

said self lubricating plastic is an ultra high molecular weight polymer;

said carbon black is present in said polymer in a range of about 1% to less than about 5% by weight of said polymer, to preserve said self lubricating properties as well as wear resistance and resistance to compression, deterioration and disintegration and to provide sufficient electrical conductivity to dissipate static discharges between the rail car bolster and the truck bolster.

2. The center bowl liner of claim 1 wherein said conductive material is present in said plastic material in an amount of about 2% by weight thereof.

3. The center bowl liner of claim 1 wherein said liner is a complete bowl having a disk portion and an upstanding cylindrical wall, or a flat disk liner.

4. The center bowl liner of claim 1 wherein said liner is a bowl having a disk portion and an upstanding cylindrical wall portion; said disk portion being formed of said homogenous mixture and said upstanding cylindrical wall being formed of said self lubricating plastic material.

5. The center bowl liner of claim 1 wherein said mixture comprises more than 1% carbon black entrained in an ultrahigh molecular weight polymer matrix.

6. The center bowl liner of claim 1, wherein said liner has a disk portion; said disk portion further comprising an outer load-bearing ring portion and an inner electrically conductive ring formed and arranged concentrically and formed to be a substantially unitary disk portion with a concentration of conductive material in a preselected location in said inner ring.

7. A bowl liner for a rail appliance comprising a uniformly constituted self lubricating conductive material having a coefficient of friction between the liner and the center bowl of about 0.2 and having an electrical resistance of less than about 100 Kohms; said conductive material is a homogenous mixture of a conductive material within a matrix of a self-lubricating plastic material;

said conductive material is carbon black powder;

said self lubricating plastic is an ultra high molecular weight polymer;

wherein said conductive material is present in said plastic material in an amount of about 2% by weight thereof.

8. The center bowl liner of claim 7 wherein said liner is a complete bowl having a disk portion and an upstanding cylindrical wall, or a flat disk liner.

9. The center bowl liner of claim 8, wherein:

said disk portion or flat liner has an outer load-bearing ring portion and an inner electrically conductive ring formed and arranged concentrically and formed to be a substantially unitary disk portion with a concentration of conductive material in a preselected location in said inner ring.

10. A bowl liner for a rail appliance comprising a uniformly constituted self lubricating conductive material having a coefficient of friction between the liner and the center bowl of about 0.2 and having an electrical resistance of less than about 100 Kohms; said conductive material is a homogenous mixture of a conductive material within a matrix of a self-lubricating plastic material;

said conductive material is carbon black powder;

said self lubricating plastic is an ultra high molecular weight polymer;

wherein said bowl liner has a disk portion;

said disk portion has a conductive ring containing from about 2% to about 5% conductive material entrained in the plastic;

said disk portion has an outer ring surrounding the conductive ring, said outer ring being composed of the structural self-lubricating material without said conductive material.

11. In a center plate assembly on a railroad car wherein said assembly includes a bolster center plate and a floor wall aligned with the center plate by a kingpin, and a self-lubricating plastic bearing liner between a center plate planar wall and a floor wall, the improvement in said plastic bearing liner which includes:

an aperture for receiving said kingpin, an outer load-bearing ring portion, and an inner electrically conductive ring integrally molded to said load-bearing portion and of substantially the same thickness as the load-bearing portion, both rings being disposed between and engaging the planar wall and floor wall with the conductive ring establishing electrical conductivity between the planar wall and floor wall, said outer and inner rings each having an upper and lower contact surface engaging said center plates and floor wall, respectively, the total area of said upper contact surface of said outer portion being substantially larger than the total area of said upper contact surface of said inner portion, said load-bearing portion being of an ultra-high molecular weight polyethylene and said conductive portion being of an ultra-high molecular weight polyethylene filled with conductive particles.

12. The center bowl liner of claim 11 wherein said carbon black is present in said inner ring in a range of about 1% to about 5% by weight of said polymer.

13. The center bowl liner of claim 11 wherein said conductive material is present in said plastic material in an amount of about 2% by weight thereof.

* * * * *

UNITED STATES PATENT AND TRADEMARK OFFICE

CERTIFICATE OF CORRECTION

PATENT NO. : 6,041,714

DATED : March 28, 2000

INVENTOR(S) : Robert S. Trent and Robert M. Manley

It is certified that error appears in the above-indentified patent and that said Letters Patent is hereby corrected as shown below:

ON THE TITLE PAGE

Item [60], Provisional Patent Application Serial No. should read --60/042,088.--

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*